US011004386B2

(12) United States Patent
Wu et al.

(10) Patent No.: US 11,004,386 B2
(45) Date of Patent: May 11, 2021

(54) METHODS FOR CALIBRATING CORRELATION BETWEEN VOLTAGE AND GRAYSCALE VALUE OF DISPLAY PANELS

(71) Applicant: SHANGHAI YUNYINGGU TECHNOLOGY CO., LTD., Shanghai (CN)

(72) Inventors: Chun-Ta Wu, New Taipei (TW); Yu-Hsing Chuang, Taipei (TW); Ying-Hao Tu, Hsinchu (TW); Wu-Hsiung Cheng, Hsinchu (TW)

(73) Assignee: KUNSHAN YUNYINGGU ELECTRONIC TECHNOLOGY CO., LTD., Kunshan (CN)

( * ) Notice: Subject to any disclaimer, the term of this patent is extended or adjusted under 35 U.S.C. 154(b) by 0 days.

(21) Appl. No.: 16/244,070

(22) Filed: Jan. 9, 2019

(65) Prior Publication Data

US 2020/0219439 A1 Jul. 9, 2020

(51) Int. Cl.
*G09G 3/3208* (2016.01)
*G09G 3/20* (2006.01)

(52) U.S. Cl.
CPC ..... *G09G 3/3208* (2013.01); *G09G 3/2003* (2013.01); *G09G 3/2007* (2013.01);
(Continued)

(58) Field of Classification Search
CPC .. G09G 3/2003; G09G 3/2007; G09G 3/3208; G09G 2320/0276;
(Continued)

(56) References Cited

U.S. PATENT DOCUMENTS 10,861,391 B2 * 12/2020 Yan ..... G09G 3/3258
2009/0058772 A1 * 3/2009 Lee ..... G09G 3/3233 345/82

(Continued)

FOREIGN PATENT DOCUMENTS

JP 2012093590 A 5/2012

OTHER PUBLICATIONS

Notice of Reasons for Refusal issued in corresponding Japanese Patent Application No. 2020-000490, dated Jan. 26, 2021, 8 pages.

*Primary Examiner* — Dmitriy Bolotin
(74) *Attorney, Agent, or Firm* — Bayes PLLC

(57) ABSTRACT

Method and system for calibrating a plurality of voltages of a light-emitting element and a plurality of grayscale values of a respective pixel of the light-emitting element on a display panel are provided. The method may include determining a mapping correlation between the plurality of voltages of the light-emitting element and a plurality of luminance values of the light-emitting element, determining N grayscale values of the pixel, and determining N first luminance values each corresponding to the respective one of the N grayscale values. The method may also include determining N first voltages mapped to the N first luminance values using the mapping correlation and determining, of each one of the N first luminance values, (M−1) second luminance values. Each one of the (M−1) second luminance values may correspond to a different dimmed luminance value of the respective first luminance value.

25 Claims, 13 Drawing Sheets

(52) U.S. Cl.
CPC ..... *G09G 2320/0276* (2013.01); *G09G 2320/0626* (2013.01); *G09G 2320/0666* (2013.01); *G09G 2320/0693* (2013.01)

(58) Field of Classification Search
CPC ... G09G 2320/0626; G09G 2320/0666; G09G 2320/0693
See application file for complete search history.

(56) References Cited

U.S. PATENT DOCUMENTS

| | | | | |
|---|---|---|---|---|
| 2011/0234644 | A1* | 9/2011 | Park | G09G 3/2003 345/690 |
| 2012/0105502 | A1* | 5/2012 | Yokoyama | G09G 3/30 345/690 |
| 2013/0135272 | A1* | 5/2013 | Park | G09G 3/3233 345/211 |
| 2014/0306979 | A1* | 10/2014 | Chun | G09G 3/3208 345/589 |
| 2015/0340008 | A1* | 11/2015 | Yang | G09G 5/06 345/601 |
| 2016/0133192 | A1* | 5/2016 | Chae | G09G 3/3258 345/205 |
| 2016/0140891 | A1* | 5/2016 | Lim | G09G 3/2007 345/690 |
| 2016/0351139 | A1* | 12/2016 | Syu | G09G 3/36 |
| 2016/0351165 | A1* | 12/2016 | Chang | G06F 3/04842 |
| 2017/0206825 | A1* | 7/2017 | Cha | G09G 3/2092 |
| 2019/0122607 | A1* | 4/2019 | Yan | G09G 3/20 |
| 2020/0035141 | A1* | 1/2020 | Yang | G09G 5/02 |
| 2020/0126484 | A1* | 4/2020 | Yan | G09G 3/3233 |

* cited by examiner

METHODS FOR CALIBRATING CORRELATION BETWEEN VOLTAGE AND GRAYSCALE VALUE OF DISPLAY PANELS

BACKGROUND

The disclosure relates generally to display technologies, and more particularly, to display panel calibration.

Organic light-emitting diode (OLED) display panels are widely used in different fields to display images of various colors, luminance values, and grayscale values. The luminance and grayscale of a display panel are partially dependent on the characteristics of the OLEDs on the display panel. Due to the nonuniformity of fabrication process, OLEDs of one display panel may be different from OLEDs of another display panel. For example, the threshold voltage of an OLED can be different from that of another OLED, causing the amount of light emitted by these OLEDs to vary when a same driving voltage is applied on them. This nonuniformity in luminance values can result in nonuniformity in grayscale values of the OLEDs, resulting in display performance of a display panel to be different from one another. Thus, a calibration of display panels is often performed, e.g., by the manufacturer, to ensure display characteristics of OLEDs to be consistent/uniform in these display panels.

The calibration process often includes a Gamma correction that adjusts the grayscale values of a pixel (e.g., one or more subpixels/OLEDs) under different gate voltages applied on the pixel so the grayscale values of different pixels in the same display panel and/or different display panels can be consistent. Because of the nonuniformities in pixels/subpixels, the correlation between the grayscale values and gate voltages can vary amongst different pixels, affecting the Gamma correction. It is thus important to obtain an accurate correlation between the grayscale values and the gate voltages in OLED display panels.

SUMMARY

In one example, a method for calibrating a plurality of voltages of a light-emitting element and a plurality of grayscale values of a respective pixel of the light-emitting element on a display panel is provided. The method includes determining a mapping correlation between the plurality of voltages of the light-emitting element and a plurality of luminance values of the light-emitting element, determining N grayscale values of the pixel, and determining N first luminance values each corresponding to the respective one of the N grayscale values. N may be a positive integer and less than a number of the plurality of grayscale values. The method also includes determining N first voltages mapped to the N first luminance values using the mapping correlation, and determining (M−1) second luminance values of each one of the N first luminance values. Each one of the (M−1) second luminance values may correspond to a different dimmed luminance value of the respective first luminance value. M may be a positive integer. The method further includes determining, of each one of the N first luminance values, (M−1) second voltages mapped to the respective (M−1) second luminance values, and determining the plurality of voltages of the light-emitting element based on the N first voltages and (M−1)×N second voltages. The method further includes determining the plurality of grayscale values of the pixel based on the N grayscale values and (M−1)×N second luminance values, and determining a correlation of the light-emitting element between the plurality of voltages and the plurality of grayscale values by mapping the plurality of voltages to the plurality of grayscale values.

In another example, a method for calibrating voltages of a light-emitting element and luminance values of a respective pixel on a display panel includes the following operations. First, a plurality of target luminance values and a target color temperature of a respective pixel are determined. A plurality of actual voltages of the light-emitting element in response to the pixel displaying the plurality of target luminance values may also be determined. Further, a mapping correlation between the voltages and luminance values of the light-emitting element based on the plurality of target luminance values and the plurality of actual voltages may be determined.

In still another example, a system for calibrating a plurality of voltages of a light-emitting element and a plurality of grayscale values of a respective pixel on a display panel includes a display having the light-emitting element and a processor. The processor includes a grayscale-luminance converting sub-module configured to determine N first luminance values each corresponding to the respective one of N grayscale values of the pixel, a luminance-voltage correlation analyzing sub-module configured to determine a mapping correlation between a voltage of the light-emitting element and a luminance value of the light-emitting element, and a grayscale-voltage mapping sub-module configured to determine N first voltages mapped to the N first luminance values using the mapping correlation. The processor also includes a luminance-voltage mapping sub-module configured to determining, for each one of the N first luminance values, (M−1) second luminance values and (M−1) second voltages mapped to the respective (M−1) second luminance values. Each one of the (M−1) second luminance values corresponds to a different dimmed luminance value of the respective first luminance value, M being a positive integer. The processor also includes an interpolating sub-module configured to determine the plurality of voltages of the light-emitting element based on the N first voltages and (M−1)×N second voltages, determine the plurality of grayscale values of the pixel based on the N grayscale values and (M−1)×N second luminance values, and determine a correlation of the light-emitting element between the plurality of voltages and the plurality of grayscale values by mapping the plurality of voltages to the plurality of grayscale values.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
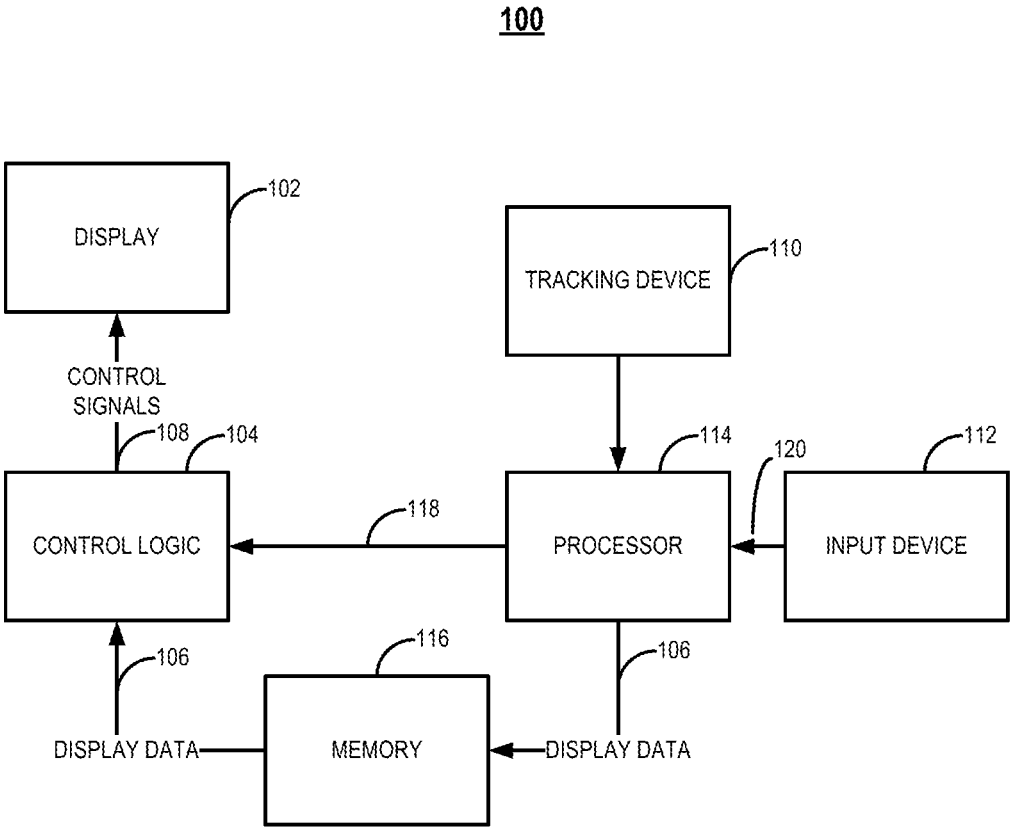
FIG. 1 is a block diagram illustrating an apparatus including a display and control logic in accordance with some embodiments.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and," "or," or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As will be disclosed in detail below, among other novel features, the display system, apparatus, and methods in the present disclosure can calibrate a mapping correlation between the voltages (e.g., gate voltage) applied on a light-emitting element (e.g., an OLED as a subpixel) and the grayscale values represented by the light-emitting element. The mapping correlation may be used to determine the gate voltage at a desired grayscale value during a Gamma correction. For example, a luminance-voltage correlation analyzing sub-module is employed to first calibrate the correlation between the luminance of the OLED and the actual voltage (e.g., gate voltage) applied on the OLED. The expression of the luminance-voltage correlation analyzing sub-module can be determined by measuring at least three actual voltages of the OLED at three different luminance values displayed by a respective pixel that includes the OLED. If there is more than one OLED as subpixels in the respective pixel, the actual voltages of other OLEDs are also measured to determine their respective luminance-voltage correlations. Then, a plurality of grayscale values (e.g., N grayscale values) can be converted to corresponding luminance values and a plurality of voltages corresponding to the luminance values can be obtained based on the luminance-voltage correlation. For each of the luminance values, a set of different dimmed luminance values (e.g., (M−1) dimmed luminance values) can be obtained and voltages corresponding to these dimmed luminance values can also be obtained based on the luminance-voltage correlation. These total dimmed luminance values can be converted to corresponding grayscale values. Thus, the plurality of grayscale values and the grayscale values corresponding to the dimmed luminance values can be obtained together with voltages mapped to them. Interpolation can be performed to generate all the grayscale values and their corresponding voltages. A grayscale-voltage correlation can then be obtained.

By using the disclosed calibration methods, the total number of grayscale values and the total number of voltages measured to determine the mapping correlation between grayscale values of a pixel as a function of voltages applied on its subpixels can be greatly reduced, decreasing the time required for calibrating each display panel. For example, in a known calibration method, N×M grayscale values of a pixel and N×M voltages (e.g., gate voltages applied on a subpixel of the pixel) corresponding to the N×M grayscale values need to be measured. Interpolation can be employed to determine the rest of the grayscale values and the voltages to determine the mapping correlation. For a light-emitting element that has 10-bit grayscale value (e.g., corresponding to 10-bit or $2^{10}$ gate voltages to be applied on the light-emitting element), N can be a positive integer less than or equal to 32 and M can be a positive integer equal to or greater than 2. Using a known calibration method, when N is equal to 25 and M is equal to 4, 100 grayscale values and corresponding voltages need to be measured for a single light-emitting element. Accordingly, 300 grayscale values and corresponding voltages need to be measured for a pixel that has three light-emitting elements each displays a different primary color. By using the disclosed calibration methods, for a single light-emitting element, three voltages need to be measured to determine the mapping correlation. The N×M grayscale values and N×M voltages can be calculated based on the mapping correlation and a correlation between grayscale and luminance. That is, for a pixel that has three light-emitting elements each displaying a different primary color, only 9 voltages need to be measured to determine the three mapping correlations (e.g., between luminance and voltage applied on the three light-emitting elements). The N×M grayscale values and the N×M corresponding voltages can be obtained by calculation. The amount of time required for calibrating the entire display panel can be greatly reduced, increasing calibration productivity.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102 and control logic 104. Apparatus 100 may be any suitable device, for example, a VR/AR device (e.g., VR headset, etc.), handheld device (e.g., dumb or smart phone, tablet, etc.), wearable device (e.g., eyeglasses, wrist watch, etc.), automobile control station, gaming console, television set, laptop computer, desktop computer, netbook computer, media center, set-top box, global positioning system (GPS), electronic billboard, electronic sign, printer, or any other suitable device. In this embodiment, display 102 is operatively coupled to control logic 104 and is part of apparatus 100, such as but not limited to, a head-mounted display, computer monitor, television screen, head-up display (HUD), dashboard, electronic billboard, or electronic sign. Display 102 may be an OLED display, microLED display, liquid crystal display (LCD), E-ink display, electroluminescent display (ELD), billboard display with LED or incandescent lamps, or any other suitable type of display.

Control logic 104 may be any suitable hardware, software, firmware, or combination thereof, configured to receive display data 106 (e.g., pixel data) and generate control signals 108 for driving the subpixels on display 102. Control signals 108 are used for controlling writing of display data to the subpixels and directing operations of display 102. For example, subpixel rendering (SPR) algorithms for various subpixel arrangements may be part of control logic 104 or implemented by control logic 104. As described below in detail with respect to FIG. 5, control logic 104 in one embodiment may include a data interface 502 and a control signal generating sub-module 504 having a timing controller (TCON) 506 and a clock generator 508. Control logic 104 may include any other suitable components, such as an encoder, a decoder, one or more processors, controllers, and storage devices. Control logic 104 may be implemented as a standalone integrated circuit (IC) chip, such as an application-specific integrated circuit (ASIC) or a field-programmable gate array (FPGA). In some embodiments, control logic 104 may be manufactured in a chip-on-glass (COG) package, for example, when display 102 is a rigid display. In some embodiments, control logic 104 may be manufactured in a chip-on-film (COF) package, for example, when display 102 is a flexible display, e.g., a flexible OLED display.

Apparatus 100 may also include any other suitable component such as, but not limited to tracking devices 110 (e.g., inertial sensors, camera, eye tracker, GPS, or any other suitable devices for tracking motion of eyeballs, facial expression, head movement, body movement, and hand gesture) and input devices 112 (e.g., a mouse, keyboard, remote controller, handwriting device, microphone, scanner, etc.). Input devices 112 may transmit input instructions 120 to processor 114 to be processed and executed. For example, input instructions 120 may include computer programs and/or manual input to command processor 114 to perform a test and/or calibration operation on control logic 104 and/or display 102.

In this embodiment, apparatus 100 may be a handheld or a VR/AR device, such as a smart phone, a tablet, or a VR headset. Apparatus 100 may also include a processor 114 and memory 116. Processor 114 may be, for example, a graphics processor (e.g., graphics processing unit (GPU)), an application processor (AP), a general processor (e.g., APU, accelerated processing unit; GPGPU, general-purpose computing on GPU), or any other suitable processor. Memory 116 may be, for example, a discrete frame buffer or a unified memory. Processor 114 is configured to generate display data 106 in consecutive display frames and may temporally store display data 106 in memory 116 before sending it to control logic 104. Processor 114 may also generate other data, such as but not limited to, control instructions 118 or test signals, and provide them to control logic 104 directly or through memory 116. Control logic 104 then receives display data 106 from memory 116 or directly from processor 114.

Figure 2A:
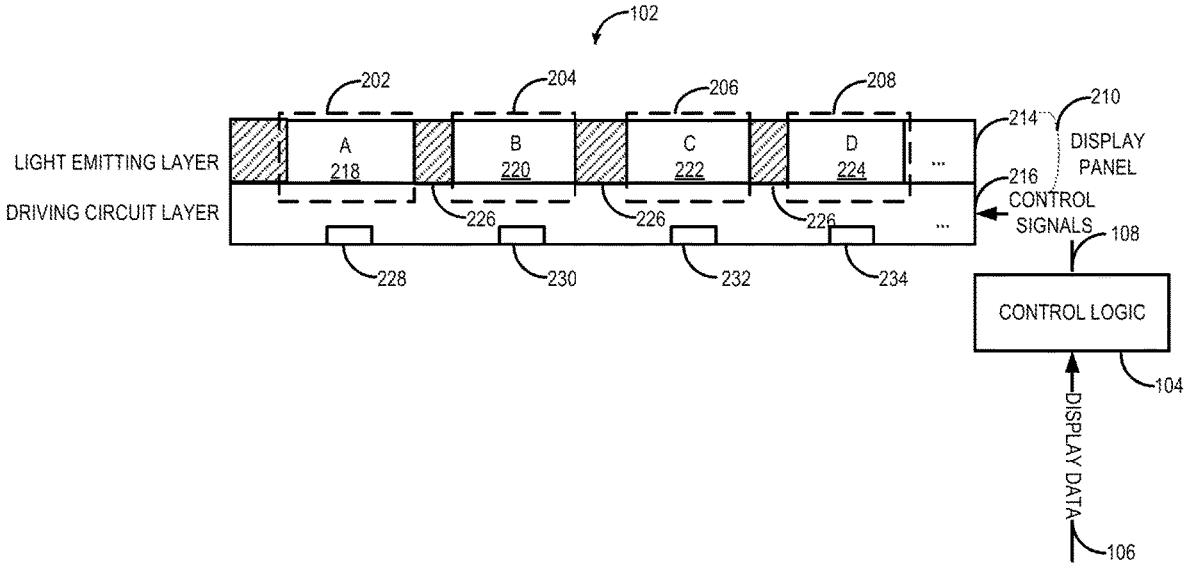
FIGS. 2A-2C are side-view diagrams illustrating various examples of the display shown in FIG. 1 in accordance with various embodiments.

FIG. 2A is a side-view diagram illustrating one example of display 102 including subpixels 202, 204, 206, and 208. Display 102 may be any suitable type of display, for example, OLED displays, such as an active-matrix OLED (AMOLED) display, or any other suitable display. Display 102 may include a display panel 210 operatively coupled to control logic 104. The example shown in FIG. 2A illustrates a side-by-side (a.k.a. lateral emitter) OLED color patterning architecture in which one color of light-emitting material is deposited through a metal shadow mask while the other color areas are blocked by the mask.

In this embodiment, display panel 210 includes light emitting layer 214 and a driving circuit layer 216. As shown in FIG. 2A, light emitting layer 214 includes a plurality of light emitting elements (e.g., OLEDs) 218, 220, 222, and 224, corresponding to a plurality of subpixels 202, 204, 206, and 208, respectively. A, B, C, and D in FIG. 2A denote OLEDs in different colors, such as but not limited to, red, green, blue, yellow, cyan, magenta, or white. Light emitting layer 214 also includes a black array 226 disposed between OLEDs 218, 220, 222, and 224, as shown in FIG. 2A. Black array 226, as the borders of subpixels 202, 204, 206, and 208, is used for blocking light coming out from the parts outside OLEDs 218, 220, 222, and 224. Each OLED 218, 220, 222, and 224 in light emitting layer 214 can emit light in a predetermined color and brightness.

In this embodiment, driving circuit layer 216 includes a plurality of pixel circuits 228, 230, 232, and 234, each of which includes one or more thin film transistors (TFTs), corresponding to OLEDs 218, 220, 222, and 224 of subpixels 202, 204, 206, and 208, respectively. Pixel circuits 228, 230, 232, and 234 may be individually addressed by control signals 108 from control logic 104 and configured to drive corresponding subpixels 202, 204, 206, and 208, by controlling the light emitting from respective OLEDs 218, 220, 222, and 224, according to control signals 108. Driving circuit layer 216 may further include one or more drivers (not shown) formed on the same substrate as pixel circuits 228, 230, 232, and 234. The on-panel drivers may include circuits for controlling light emitting, gate scanning, and data writing as described below in detail. Scan lines and data lines are also formed in driving circuit layer 216 for transmitting scan signals and data signals, respectively, from the drivers to each pixel circuit 228, 230, 232, and 234. Display panel 210 may include any other suitable component, such as one or more glass substrates, polarization layers, or a touch panel (not shown). Pixel circuits 228, 230, 232, and 234 and other components in driving circuit layer 216 in this embodiment are formed on a low temperature polycrystalline silicon (LTPS) layer deposited on a glass substrate, and the TFTs in each pixel circuit 228, 230, 232, and 234 are p-type transistors (e.g., PMOS LTPS-TFTs). In some embodiments, the components in driving circuit layer 216 may be formed on an amorphous silicon (a-Si) layer, and the TFTs in each pixel circuit may be n-type transistors (e.g., NMOS TFTs). In some embodiments, the TFTs in each pixel circuit may be organic TFTs (OTFT) or indium gallium zinc oxide (IGZO) TFTs.

As shown in FIG. 2A, each subpixel 202, 204, 206, and 208 is formed by at least an OLED 218, 220, 222, and 224 driven by a corresponding pixel circuit 228, 230, 232, and 234. Each OLED may be formed by a sandwich structure of an anode, an organic light-emitting layer, and a cathode. Depending on the characteristics (e.g., material, structure, etc.) of the organic light-emitting layer of the respective OLED, a subpixel may present a distinct color and brightness. Each OLED 218, 220, 222, and 224 in this embodiment is a top-emitting OLED. In some embodiments, the OLED may be in a different configuration, such as a bottom-emitting OLED. In one example, one pixel may consist of three subpixels, such as subpixels in the three primary colors (red, green, and blue) to present a full color. In another example, one pixel may consist of four subpixels, such as subpixels in the three primary colors (red, green, and blue) and the white color. In still another example, one pixel may consist of two subpixels. For example, subpixels A 202 and B 204 may constitute one pixel, and subpixels C 206 and D 208 may constitute another pixel. Here, since display data 106 is usually programmed at the pixel level, the two subpixels of each pixel or the multiple subpixels of several adjacent pixels may be addressed collectively by SPRs to present the appropriate brightness and color of each pixel, as designated in display data 106 (e.g., pixel data). However, it is to be appreciated that, in some embodiments, display data 106 may be programmed at the subpixel level such that display data 106 can directly address individual subpixel without SPRs. Because it usually requires three primary colors to present a full color, specifically designed subpixel arrangements may be provided for display 102 in conjunction with SPR algorithms to achieve an appropriate apparent color resolution.

Figure 2B:
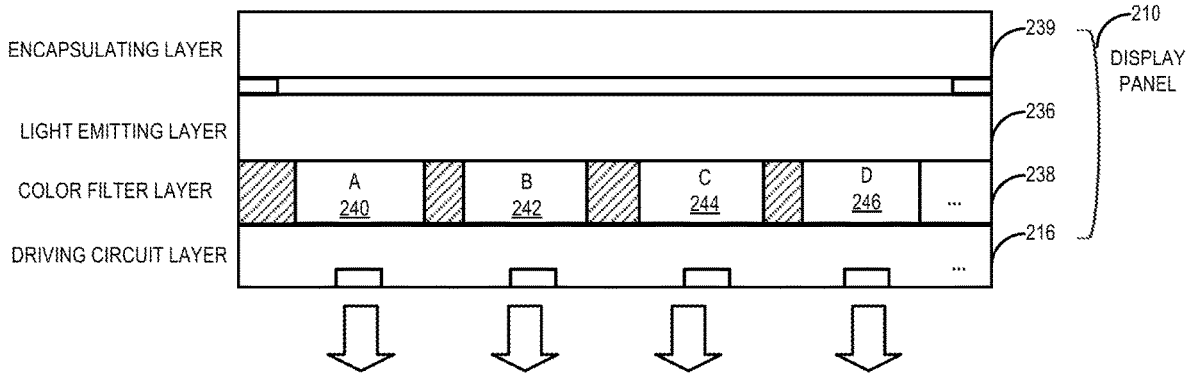

The example shown in FIG. 2A illustrates a side-by-side patterning architecture in which one color of light-emitting material is deposited through the metal shadow mask while the other color areas are blocked by the mask. In another example, a white OLEDs with color filters (WOLED+CF) patterning architecture can be applied to display panel 210. In the WOLED+CF architecture, a stack of light-emitting materials form light emitting layer of the white light. The color of each individual subpixel is defined by another layer of color filters in different colors. As the organic light-emitting materials do not need to be patterned through the metal shadow mask, the resolution and display size can be increased by the WOLED+CF patterning architecture. FIG. 2B illustrates an example of a WOLED+CF patterning architecture applied to display panel 210. Display panel 210 in this embodiment includes driving circuit layer 216, light emitting layer 236, a color filter layer 238, and an encapsulating layer 239. In this example, light emitting layer 236 includes a stack of light emitting sub-layers and emits the white light. Color filter layer 238 may be comprised of a color filter array having a plurality of color filters 240, 242, 244, and 246 corresponding to subpixels 202, 204, 206, and 208, respectively. A, B, C, and D in FIG. 2B denote four different colors of filters, such as but not limited to, red, green, blue, yellow, cyan, magenta, or white. Color filters 240, 242, 244, and 246 may be formed of a resin film in which dyes or pigments having the desired color are contained. Depending on the characteristics (e.g., color, thickness, etc.) of the respective color filter, a subpixel may present a distinct color and brightness. Encapsulating layer 239 may include an encapsulating glass substrate or a substrate fabricated by the thin film encapsulation (TFE) technology. Driving circuit layer 216 may be comprised of an array of pixel circuits including LTPS, IGZO, or OTFT transistors. Display panel 210 may include any other suitable components, such as polarization layers, or a touch panel (not shown).

Figure 2C:
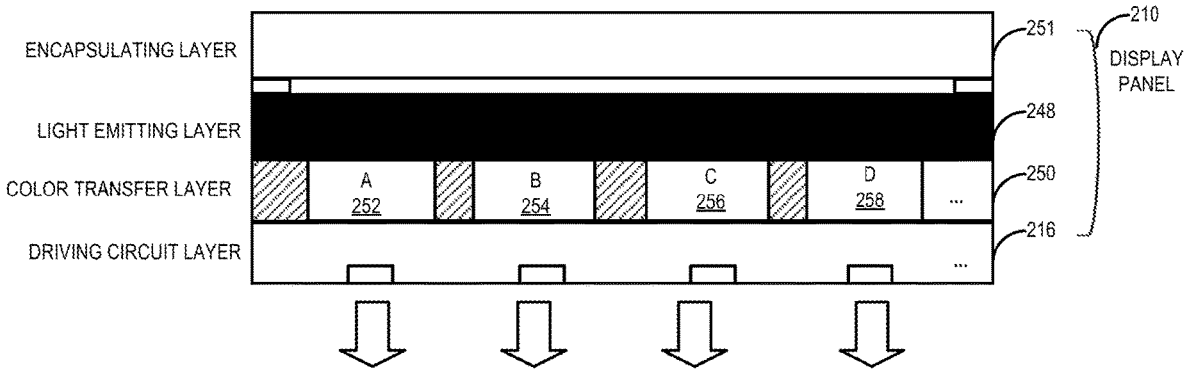

In still another example, a blue OLEDs with transfer color filters (BOLED+ transfer CF) patterning architecture can be applied to display panel 210 as well. In the BOLED+ transfer CF architecture, light-emitting material of blue light is deposited without a metal shadow mask, and the color of each individual subpixel is defined by another layer of transfer color filters for different colors. FIG. 2C illustrates an example of a BOLED+ transfer CF patterning architecture applied to display panel 210. Display panel 210 in this embodiment includes driving circuit layer 216, light emitting layer 248, a color transfer layer 250, and an encapsulating layer 251. Light emitting layer 248 in this embodiment emits the blue light and can be deposited without a metal shadow mask. It is to be appreciated that in some embodiments, light emitting layer 248 may emit other colors of light. Color transfer layer 250 may be comprised of a transfer color filters array having a plurality of transfer color filters 252, 254, 256, and 258 corresponding to subpixels 202, 204, 206, and 208, respectively. A, B, C, and D in FIG. 2C denote four different colors of transfer color filters, such as but not limited to, red, green, blue, yellow, cyan, magenta, or white. Each type of transfer color filter may be formed of a color changing material. Depending on the characteristics (e.g., color, thickness, etc.) of the respective transfer color filter, a subpixel may present a distinct color and brightness. Encapsulating layer 251 may include an encapsulating glass substrate or a substrate fabricated by the TFE technology. Driving circuit layer 216 may be comprised of an array of pixel circuits including LTPS, IGZO, or OTFT transistors. Display panel 210 may include any other suitable component, such as polarization layers, or a touch panel (not shown).

The display panel driving scheme disclosed herein is suitable for any known OLED patterning architectures, including but not limited to, the side-by-side, WOLED+CF, and BOLED+ CCM patterning architectures as described above. Although FIGS. 2A-2C are illustrated as an OLED display, it is to be appreciated that they are provided for an exemplary purpose only and without limitations. In some embodiments, the display panel driving scheme disclosed herein may be applied to microLED displays in which each subpixel includes a microLED. The display panel driving scheme disclosed herein may be applied to any other suitable displays in which each subpixel includes light emitting element.

Figure 3:
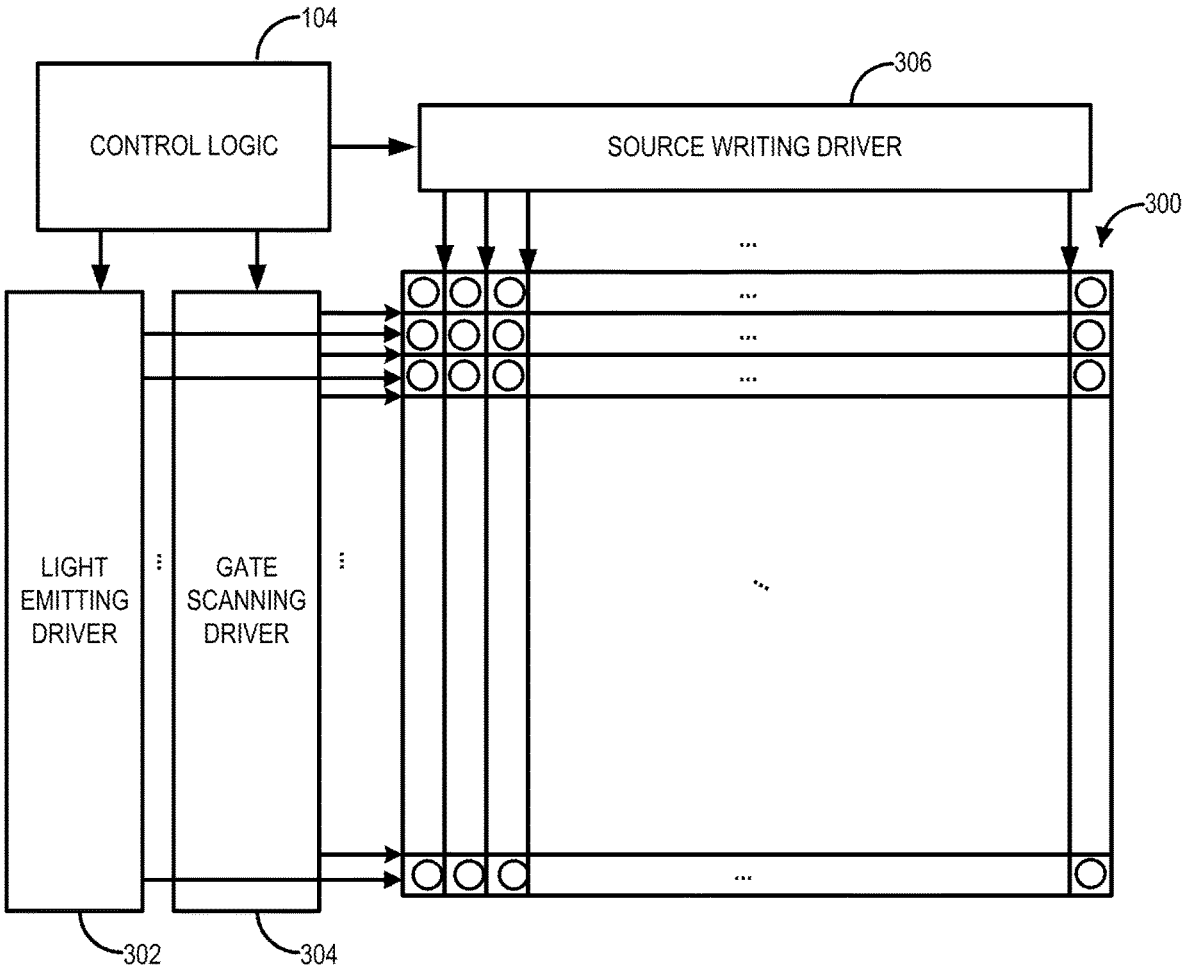
FIG. 3 is a block diagram illustrating the display shown in FIG. 1 including multiple drivers in accordance with some embodiments.

FIG. 3 is a block diagram illustrating display 102 shown in FIG. 1 including multiple drivers in accordance with some embodiments. Display 102 in this embodiment includes an active region 300 having a plurality of subpixels (e.g., each including an OLED or microLED), a plurality of pixel circuits (not shown), and multiple on-panel drivers including light emitting driver 302, a gate scanning driver 304, and a source writing driver 306. Light emitting driver 302, gate scanning driver 304, and source writing driver 306 are operatively coupled to control logic 104 and configured to drive the subpixels in active region 300 based on control signals 108 provided by control logic 104.

In some embodiments, control logic 104 is an integrated circuit (but may alternatively include a state machine made of discrete logic and other components), which provides an interface function between processor 114/memory 116 and display 102. Control logic 104 may provide various control signals 108 with suitable voltage, current, timing, and demultiplexing, to control display 102 to show the desired text or image. Control logic 104 may be an application-specific microcontroller and may include storage units such as RAM, flash memory, EEPROM, and/or ROM, which may store, for example, firmware and display fonts. In this embodiment, control logic 104 includes a data interface and a control signal generating sub-module. The data interface may be any serial or parallel interface, such as but not limited to, display serial interface (DSI), display pixel interface (DPI), and display bus interface (DBI) by the Mobile Industry Processor Interface (MIPI) Alliance, unified display interface (UDI), digital visual interface (DVI), high-definition multimedia interface (HDMI), and DisplayPort (DP). The data interface in this embodiment is configured to receive display data 106 and any other control instructions 118 or test signals from processor 114/memory 116. The control signal generating sub-module may provide control signals 108 to on-panel drivers 302, 304, and 306. Control signals 108 control on-panel drivers 302, 304, and 306 to drive the subpixels in active region 300 by, in each frame, scanning the subpixels to update display data and causing the subpixels to emit light to present the updated display image.

Figure 4A:
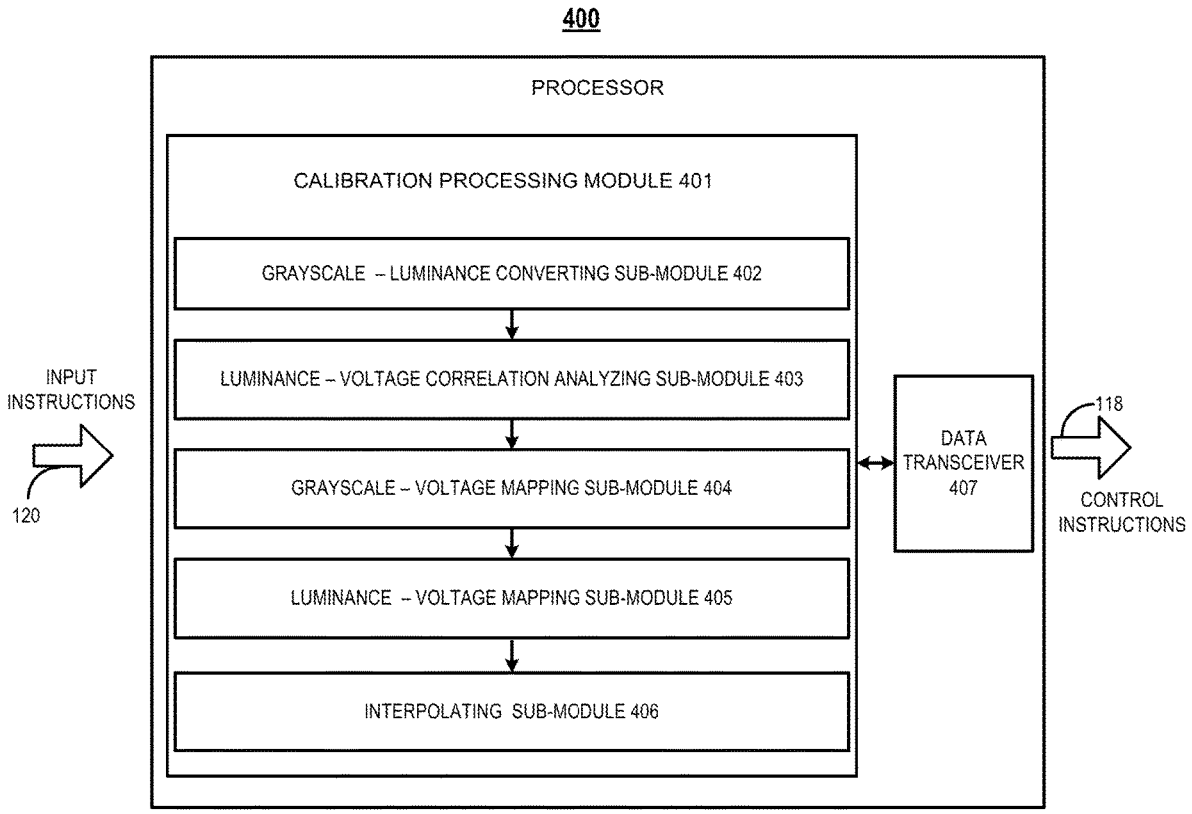
FIG. 4A is a block diagram illustrating the processor shown in FIG. 1 including multiple sub-modules in accordance with some embodiments.

Apparatus 100 can be configured to calibrate a mapping correlation between voltage (e.g., gate voltage) applied on a light-emitting element (e.g., an OLED) of a pixel in display panel 210 and the grayscale values displayed by a pixel that includes the light-emitting element (e.g., when different gate voltages are applied on the light-emitting element). The calibration process may be performed by a processor 400 (e.g., illustrated in FIGS. 4A and 4B) coupled to control logic 104. The correlation can be used as a lookup table (LUT) for Gamma correction on display panel 210. In various embodiments, the processor 400 may perform a prestored computer program from memory 116 or from input device 112, or receive input instructions 120 from input device 112 to execute the calibration. In some embodiments, the calibration process may also be performed by processor 114 alone or with the processor illustrated in FIGS. 4A and 4B. In some embodiments, processor 114 may re-calibrate the mapping correlation. The calibration process may also be performed by other dedicated devices/modules (not shown in FIG. 1). FIG. 4A illustrates an exemplary block diagram of processor 400 configured to perform the calibration. For ease of description, the light-emitting element may be referred to as an OLED. The light-emitting element/OLED can function as a subpixel of the respective pixel.

As shown in FIG. 4A, processor 400 may include a calibration processing module 401 and a data transceiver 407 operatively coupled to calibration processing module 401. Calibration processing module 401 may determine a grayscale-voltage correlation (e.g., a mapping correlation between grayscale values of the respective pixel and gate voltages applied on a subpixel of the pixel (e.g., an OLED) and may include a grayscale-luminance converting sub-module 402, a luminance-voltage correlation analyzing sub-module 403, a grayscale-voltage mapping sub-module 404, a luminance-voltage mapping sub-module 405, an interpolating sub-module 406, and a data transceiver 407. The grayscale-voltage correlation may be employed as a LUT for a Gamma correction for display panel 210. Processor 400 may receive input instructions 120, e.g., from input device 112, for performing a calibration on the grayscale-voltage correlation of each subpixel. Processor 400 may also perform a prestored (e.g., in memory 116) computer program to perform the calibration process. Processor 400 may also transmit data and control instructions 118 during the calibration to control logic 104 to collect data (e.g., actual gate voltages applied on OLEDs of display 102) used for the calibration and transmit results of calculation to control logic 104 for generating respective control signals. Data transceiver 407 may be operatively coupled to calibration processing module 401 to transmit data and/or control instructions to control logic 104 and/or receive data from control logic 104. Details of the functions of each sub-module are described in detail as follows.

Grayscale-luminance converting sub-module 402 may convert a grayscale value to a corresponding luminance value. In some embodiments, the conversion between a grayscale value and its corresponding luminance value is described by a power-law expression, where the luminance is proportional to the grayscale value raised by power $\gamma$. Power $\gamma$ may be a predetermined number such as a Gamma value for Gamma correction, e.g., $\gamma=2.2$. In some embodiments, grayscale-luminance converting sub-module 402 may convert a grayscale value to its corresponding luminance value according to the power-law expression.

Luminance-voltage correlation analyzing sub-module 403 may determine a mapping correlation ("luminance-voltage correlation") between the voltages (e.g., gate voltages) applied on a subpixel and the luminance values displayed by the subpixel under different voltages. The luminance-voltage correlation describes a luminance value of a subpixel at a different voltage. The voltage can include values of the working gate voltages that can be applied on the subpixel. In some embodiments, processor 400 employs the luminance-voltage correlation as a LUT to determine the voltage of a subpixel given a desired luminance value, and vice versa.

Figure 4B:
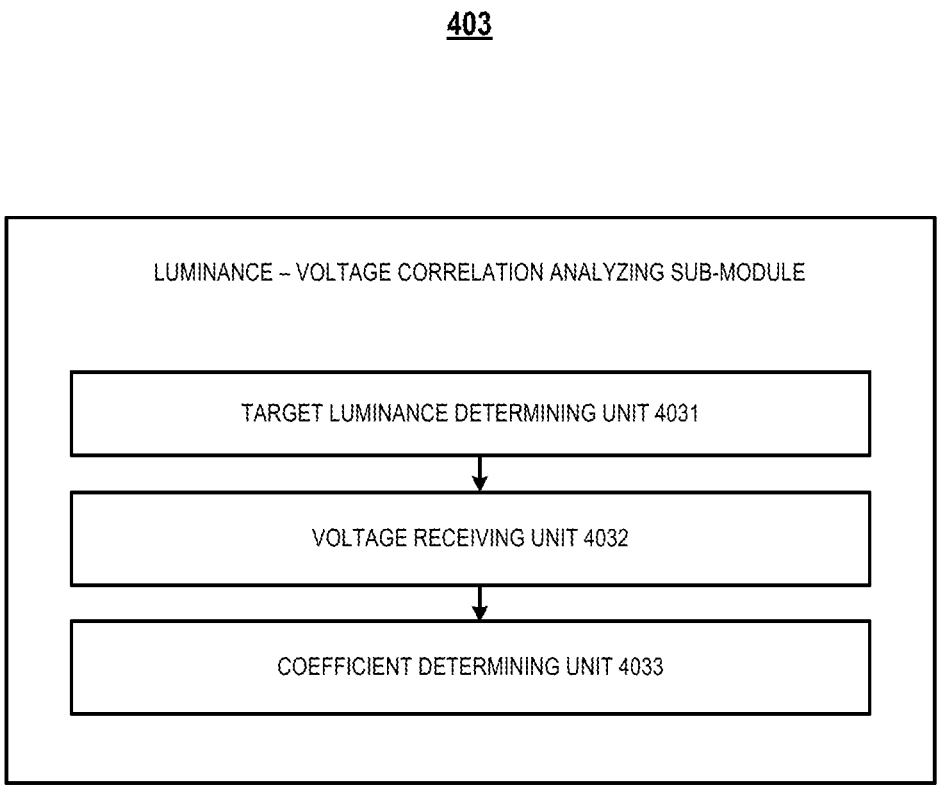
FIG. 4B is a block diagram illustrating the luminance-voltage correlation analyzing sub-module shown in FIG. 4A in accordance with some embodiments.

FIG. 4B illustrates an exemplary block diagram of luminance-voltage correlation analyzing sub-module 403, according to some embodiments. Luminance-voltage correlation analyzing sub-module 403 may determine the luminance-voltage correlation of an OLED (e.g., subpixel) when a gate voltage is applied thereon. The luminance-voltage correlation may include a plurality of voltages and a plurality of corresponding luminance values. Each luminance value may be mapped to its corresponding voltage, and vice versa. The voltages may include the gate voltage applied on the OLED to enable the OLED to display the luminance values in its range of operation (e.g., from the minimum luminance value to the maximum luminance value). In some embodiments, luminance-voltage correlation analyzing sub-module 403 determines the luminance-voltage correlation of each subpixel of a respective pixel. As shown in FIG. 4B, luminance-voltage correlation analyzing sub-module 403 may include a target luminance determining unit 4031, a voltage receiving unit 4032, and a coefficient determining unit 4033.

In some embodiments, target luminance determining unit 4031 determines a plurality of target luminance values of the respective pixel, for determining the luminance-voltage correlation. In some embodiments, depending on, e.g., the number of subpixels in the respective pixel and/or the predicted correlation between the luminance values and voltages, at least three different target luminance values are determined. In some embodiments, the pixel includes three subpixels each displaying a different primary color, and the target luminance values include a maximum luminance value and two other luminance values smaller than the maximum luminance value. When the pixel displays the maximum luminance value, the pixel (e.g., all the subpixels of the pixel) may display a white color. In some embodiments, target luminance determining unit 4031 also determines a target color temperature of the pixel that maintains unchanged/constant when different luminance values are displayed by display panel 210.

In some embodiments, target luminance determining unit 4031 transmits data of a target luminance value and the target color temperature to control logic 104, e.g., through data transceiver 407. After receiving the target luminance value and the target color temperature, control logic 104 may determine and adjust the gate voltages applied on all the subpixels of the pixel so the pixel can display the desired target luminance value at the color temperature. In some embodiments, target luminance determining unit 4031 transmits the at least three target luminance values to control logic 104, which adjusts the gate voltages applied on the subpixels and maintains the color temperature when a different target luminance value is displayed by the pixel. When the desired target luminance value is reached, voltage receiving unit 4032 receives and stores, from control logic 104 and through data transceiver 407, the actual gate voltage applied on each subpixel.

In some embodiments, coefficient determining unit 4033 receives the actual gate voltages of each subpixel at different target luminance values, and determines the luminance-voltage correlation of the subpixel. In some embodiments, luminance-voltage correlation analyzing sub-module 403 employs a binomial, i.e., $L=ax^2+bx+c$, to describe the correlation between voltages and luminance. In this binomial, variable L represents the luminance value of the pixel, variable x represents the gate voltage of a subpixel, and coefficients a, b, and c represent constants associated with the subpixel, respectively. Coefficient determining unit 4033 may determine coefficients a, b, and c for each subpixel using the target luminance value and the measured actual gate voltages applied on the subpixel. In some embodiments, at least three target luminance values and corresponding gate voltages are used to determine coefficients a, b, and c for one subpixel. The binomial, after coefficients a, b, and c are determined, may be employed as a LUT for determining the luminance value of the subpixel at a desired gate voltage applied on the subpixel, and vice versa. In some embodiments, more than three target luminance values and their corresponding gate voltages may be recorded to determine the luminance-voltage correlation of a subpixel. A polynomial with a degree of at least 2 can be used to determine the luminance-voltage correlation. For example, four target luminance values and their corresponding gate voltages may be employed to determine a polynomial of $L=a'x^3+b'x^2+c'x+d$, where coefficients a', b', c', and d represents constants associated with subpixel, respectively, and L represents luminance value of the pixel. The number of degree of a polynomial that describes the luminance-voltage correlation of a subpixel should not be limited to the embodiments of the present disclosure.

Figure 4C:
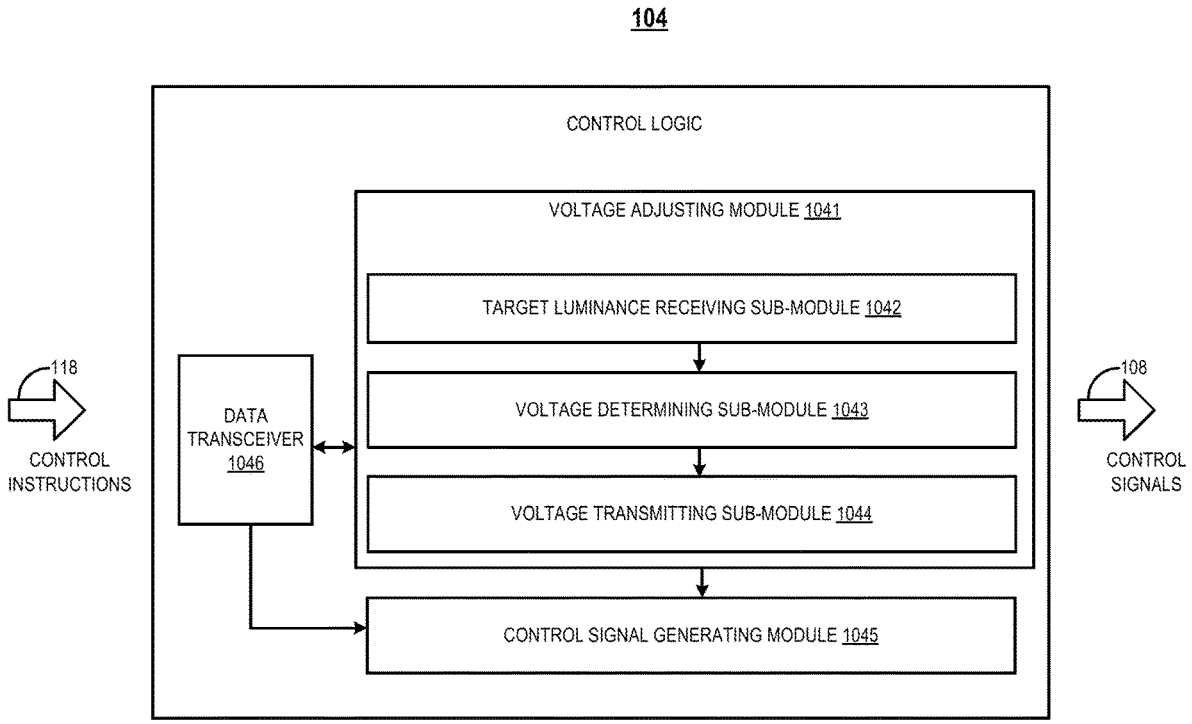
FIG. 4C is a block diagram illustrating the controller shown in FIG. 1 including multiple sub-modules in accordance with some embodiments.

FIG. 4C illustrates a block diagram of control logic 104 shown in FIG. 1, according to some embodiments. Control logic 104 may include a voltage adjusting module 1041, a control signal generating module 1045, and a data transceiver 1046 operatively coupled to voltage adjusting module 1041 and control signal generating module 1045. Voltage adjusting module 1041 may adjust a gate voltage applied on a subpixel based on a target luminance value, and transmit the value of the gate voltage to processor 400, e.g., through data transceiver 1046. Voltage adjusting module 1041 may include a target luminance receiving sub-module 1042, a voltage determining sub-module 1043, and a voltage transmitting sub-module 1044. In some embodiments, control logic 104 receives a target luminance value of a pixel, adjusts the gate voltages applied on the subpixels of pixel, and transmits the values of the gate voltages to luminance-voltage correlation analyzing sub-module 403 (e.g., voltage receiving unit 4032). Data transceiver 1046 may receive data and/or control instructions 118 from processor 400 (e.g., data transceiver 407), and transmit data (e.g., actual gate voltages) to processor 400. Control signal generating module 1045 may be coupled to data transceiver 1046 and voltage adjusting module 1041 and may generate control signals 108 corresponding to the data and/or control instructions received from them. Control signals 108 may control drivers (e.g., light emitting driver 302, gate scanning driver 304, and/or source writing driver 306) to apply desired voltages on a desired OLED. In some embodiments, the modules and/or functions of control logic 104 may also be implemented by other components of apparatus 100 (e.g., processor 114) or a dedicated component (e.g., not described in FIG. 1). The functions and modules should not be limited to control logic 104 for other functions.

In some embodiments, target luminance receiving sub-module 1042 may receive data of a target luminance value from luminance voltage correlation analyzing sub-module 403 (e.g., target luminance determining unit 4031), e.g., through data transceiver 1046. The data of the target luminance value may also include information of the address and target color temperature of the pixel. In some embodiments, based on the data of the target luminance value, voltage determining sub-module 1043 calculates the gate voltages to be applied on each subpixel for the pixel to reach the target luminance value. Control signal generating module 1045 may generate control signals 108 for locating the pixel, adjusting the gate voltages of each subpixel, and maintaining the color temperature of the pixel. Control signals 108 may be transmitted to, e.g., gate scanning driver 304 of display 102, so that gate scanning driver 304 may apply the gate voltages on the corresponding subpixels. The pixel may accordingly display the target luminance value. In some embodiments, voltage determining sub-module 1043 may continuously adjust the gate voltages applied on each subpixel when a different target luminance value is received by control logic 104. In some embodiments, voltage transmitting sub-module 1044 detects and measures the gate voltages applied on each subpixel when the target luminance value is reached. Voltage transmitting sub-module 1044 may then transmit the measured gate voltages (e.g., actual gate voltages) to luminance voltage correlation analyzing sub-module 403 (e.g., voltage receiving unit 4032), e.g., through data transceiver 1046, for subsequent processing/calculation.

The process to determine the luminance-voltage correlation is described as follows. For ease of illustration, embodiments of the present disclosure are now described in view of a pixel that has three subpixels/OLEDs, each displaying one of red, green, and blue colors. In an example, target luminance determining unit 4031 may determine a first target luminance value of the pixel to be the maximum luminance value, a second target luminance value of the pixel to be 75% of the first target luminance value, and a third target luminance value of the pixel to be 50% of the second target luminance value. Target luminance determining unit 4031 may transmit data of the target luminance values to control logic 104 so that control logic 104 may generate control signals to enable a desired pixel in display panel 210 to display the target luminance values. Voltage receiving unit 4032 may receive actual gate voltages of the subpixels of the pixel when displaying the target luminance value, e.g., measured by control logic 104. Coefficient determining unit 4033 may then determine the coefficients in the luminance-voltage correlation for each subpixel.

In some embodiments, the first, second, and third target luminance values of the pixels may be L1, L2, and L3, respectively. The actual gate voltage of the red pixel at the first, second, and third target luminance values may be VR1, VR2, and VR3, respectively. Similarly, the actual gate voltage of the green and blue subpixels may be VG1, VG2, VG3, and VB1, VB2, VB3, respectively.

Coefficient determining unit 4033 may determine the values of coefficients a, b, and c for the red subpixel by solving an equation set of:

$$L1=a\times VR1^2+b\times VR1+c;$$

$$L2=a\times VR2^2+b\times VR2+c;\ and$$

$$L3=a\times VR3^2+b\times VR3+c.$$

Similarly, coefficients a's, b's, and c's for the green subpixel and blue subpixel can respectively be determined by solving equation sets of:

$$L1=a\times VG1^2+b\times VG1+c;$$

$$L2=a\times VG2^2+b\times VG2+c;$$

$$L3=a\times VG3^2+b\times VG3+c;$$

$$L1=a\times VB1^2+b\times VB1+c;$$

$$L2=a\times VB2^2+b\times VB2+c;\ and$$

$$L3=a\times VB3^2+b\times VB3+c.$$

Figure 5:
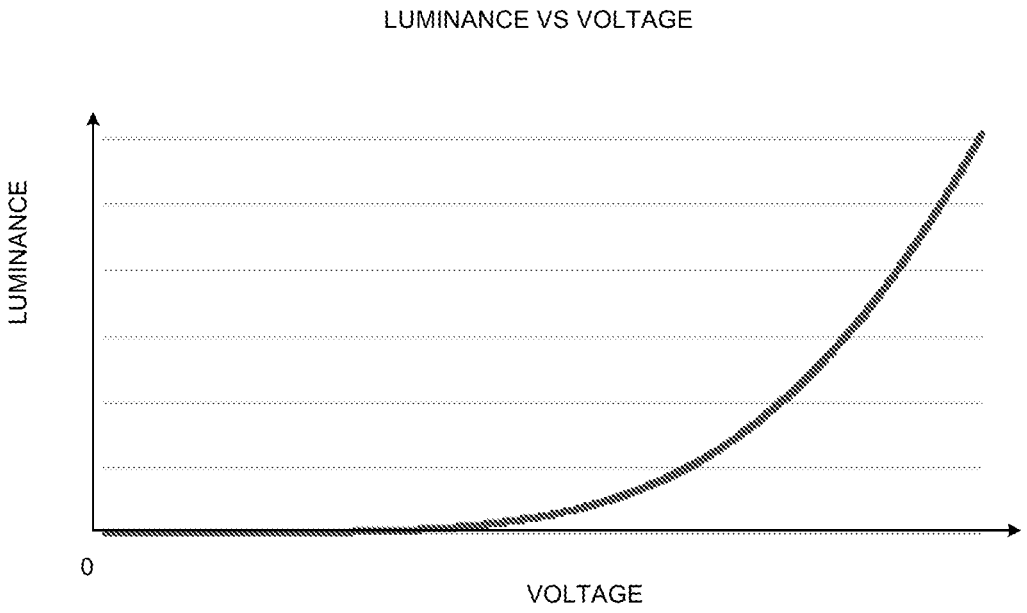
FIG. 5 illustrates an exemplary luminance-voltage correlation determined by the luminance-voltage correlation analyzing sub-module shown in FIG. 4B in accordance with some embodiments.

The luminance-voltage correlation for each subpixel can then be determined. For example, the respective expression for the red, green, and blue subpixels can be $L=a\times VR^2+b\times VR+c$; $L=a\times VG^2+b\times VG+c$; and $L=a\times VB^2+b\times VB+c$, where L represents the luminance value of the pixel, VR, VG, and VB represent gate voltages of red, green, and blue subpixels, and a, b, and c in each equation represent the respective coefficients for the red, green, and blue subpixels. FIG. 5 illustrates an example diagram of the luminance-voltage correlation, plotted based on, e.g., $L=a\times VR^2+b\times VR+c$. The x axis ("Voltage") refers to the voltage applied on the red subpixel, and the y axis ("Luminance") refers to the luminance values of the pixel as a function of the voltage. The luminance-voltage correlations of the three subpixels may be employed as a LUT to determine a luminance value of a pixel when a voltage (e.g., gate voltage) is applied on the subpixel, or vice versa.

In some embodiments, the number of target luminance values displayed by the pixel may be determined based on the predicted function of luminance of a subpixel as the gate voltage applied on the subpixel changes. For example, if the luminance-voltage correlation is predicted to be a trinomial that includes four coefficients, at least four target luminance values may need to be determined. Accordingly, at least four sub-luminance values of the red subpixel (e.g., when the pixel is displaying the at the at least four target luminance values) and the corresponding actual gate voltages may be determined to solve for the four coefficients. The number of target luminance values should not be limited by the embodiments of the present disclosure.

Referring back to FIG. 4A, grayscale-voltage mapping sub-module 404 may determine a plurality of grayscale values of the respective pixel, and determine the gate voltages mapped to the grayscale values using the luminance-voltage correlation, according to some embodiments. In some embodiments, grayscale-voltage mapping sub-module 404 may determine N grayscale values of the pixel and the N gate voltages of each subpixel when the pixel displays the N grayscale values, e.g., using the luminance-voltage correlation of the respective subpixel. N may be a suitable positive integer smaller than the total grayscale values that can be displayed by the pixel. For example, N may be 25. For each grayscale value, grayscale-luminance converting sub-module 402 may determine N luminance values (e.g., N first luminance values) corresponding to the N grayscale values using, e.g., the power-law expression. Grayscale-voltage mapping sub-module 404 may then determine the gate voltages (e.g., applied on each subpixel) mapped to the N first luminance values based on the luminance-voltage correlation for each of the red, green, and blue subpixels. In some embodiments, grayscale-voltage mapping sub-module 404 determines N gate voltages (e.g., N first voltages) corresponding to the N grayscale values for each subpixel.

In some embodiments, for each subpixel, luminance-voltage mapping sub-module 405 may determine N sets of luminance values (e.g., second luminance values), and determine the gate voltages mapped to the N sets of second luminance values using the luminance-voltage correlation, according to some embodiments. In some embodiments, each set of luminance values includes (M−1) second luminance values. The (M−1) second luminance values may each be a different dimmed luminance value of a different one of the N first luminance values. For example, for a first luminance value equal to L1, the set of (M−1) second luminance values corresponding to the first luminance value L1 may include (M−1) different percentages of L1 (e.g., 85%×L1, 70%×L1, 50%×L1, and 25%×L1). M may be a positive integer of at least 2. M may be the same or different in N sets of second luminance values. In some embodiments, each set includes the same number of second luminance values (M has the same value in N sets of second luminance values). The (M−1) second luminance values in different sets may be equal to the same or different percentages of the corresponding first luminance value in all N sets. In some embodiments, the (M−1) second luminance values in each one of the N sets are equal to same percentages of the respective first luminance value, e.g., each of the N sets having four second luminance values respectively equal to 85%×L1, 70%×L1, 50%×L1, and 25%×L1. Luminance-voltage mapping sub-module 405 may then employ the luminance-voltage correlation as a LUT to determine the (M−1)×N gate voltages mapped to the (M−1)×N second luminance values for the subpixel.

In some embodiments, the values of M and/or N are determined based on the number of gate voltages used in the interpolating process, which determines the mapping correlation between all the grayscale values of the pixel and the corresponding gate voltages applied on a subpixel. As described above, for each subpixel, a total number of M×N luminance values (e.g., N first luminance values and (M−1)×N second luminance values) may be determined and a total number of M×N gate voltages may be determined to map to the M×N luminance values based on the luminance-voltage correlation. As the number of grayscale values increases, the total number of M×N may also increase. For example, for a 10-bit subpixel, N may be 25 and M may be 4. For a pixel that includes red, green, and blue subpixels, M×N gate voltages each corresponding to one of the three subpixels may be determined for subsequent interpolation process.

In some embodiments, interpolating sub-module 406 determines a grayscale-voltage correlation that includes all the grayscale values of the pixel and the gate voltages (e.g., of a subpixel included in the pixel) mapped to the grayscale values, according to some embodiments. Interpolating sub-module 406 may perform interpolation processes/calculation to determine all the luminance values of the subpixel based on the M×N luminance values, and all the gate voltages mapped to the M×N luminance values. In some embodiments, interpolating sub-module 406 determines all the luminance value and all the gate voltages by respectively inserting new luminance values between known luminance values (e.g., the M×N luminance values) and inserting new gate voltages between known gate voltages (e.g., the M×N gate voltages). A new luminance value may be, e.g., an average of two known luminance values adjacent to the new luminance value, and a new gate voltage may be, e.g., an average of two known gate voltages adjacent to the new gate voltage. Interpolating sub-module 406 may transmit at least the luminance values of a subpixel obtained by interpolation to grayscale-luminance converting sub-module 402, and grayscale-luminance converting sub-module 402 may determine the grayscale values corresponding to these luminance values. In some embodiments, interpolating sub-module 406 transmits all the luminance values of a subpixel obtained by interpolation to grayscale-luminance converting sub-module 402 to obtain the grayscale values corresponding to all the luminance values. In some embodiments, grayscale-luminance converting sub-module 402 performs an inverse operation of the power-law correlation to obtain a grayscale value from its corresponding luminance value. Accordingly, interpolating sub-module 406 may map all the gate voltages to the corresponding grayscale values to obtain a grayscale-voltage correlation. For example, for a 10-bit subpixel, a number of $2^{10}$ grayscale values may be obtained, each of the grayscale value may have a unique mapping gate voltage.

Figure 6:
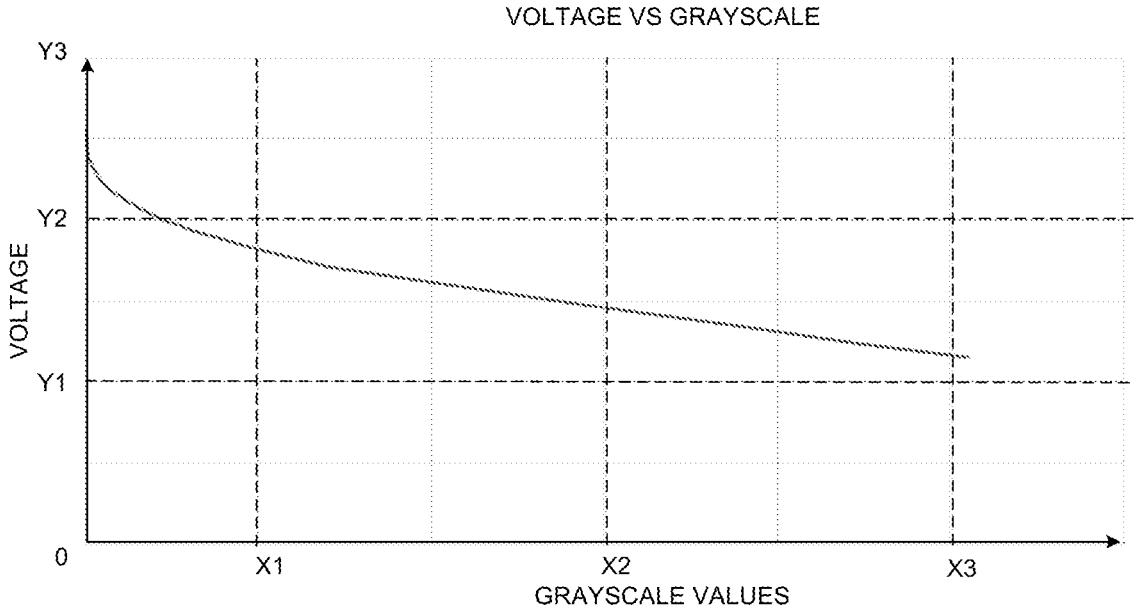
FIG. 6 illustrates an exemplary voltage-grayscale correlation determined by the processor shown in FIG. 4A in accordance with some embodiments.

FIG. 6 illustrates an exemplary grayscale-voltage correlation of one subpixel determined using the method as described above. As shown in FIG. 6, gate voltages ("voltage") vary as a function of grayscale values. In some embodiments, when performing a Gamma correction of display panel 210, the grayscale-voltage correlation may be employed as a LUT for determining the gate voltage applied on a subpixel at a desired grayscale value, or vice versa. Referring back to FIGS. 4A-4C, processor 400 may transmit the grayscale-voltage correlation of each subpixel of a pixel to control logic 104, and control logic 104 may store the grayscale-voltage correlation, e.g., in a register. During a Gamma correction, control logic 104 may employ the grayscale-voltage correlation as a LUT to generate gate voltages of each subpixel so that the respective pixel can display desired grayscale values and luminance values.

In some embodiments, calibration processing module 401 may also be integrated into control logic 104 so control logic 104 may independently determine the grayscale-voltage correlation and perform Gamma correction. For example, control logic 104 may receive control instructions 118 to calibrate the grayscale-voltage correlation of each subpixel on display panel 210 and employ the calibrated grayscale-voltage correlation for Gamma correction of display panel 210. Details of the processes can be referred to the description of FIGS. 4A-4C and are not repeated herein.

Figure 7A:
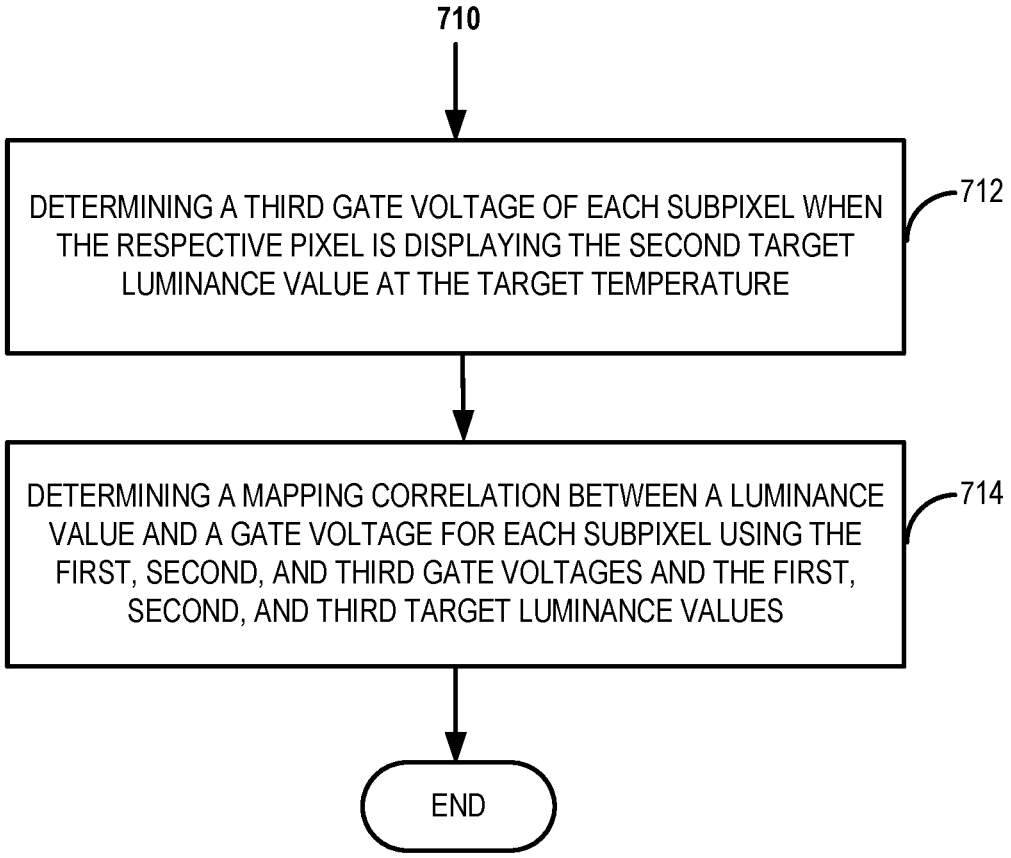
FIG. 7A illustrates an exemplary process flow to determine a luminance-voltage correlation in accordance with some embodiments.

FIG. 7A illustrates a flow chart of a method 700 for determining a luminance-voltage correlation in a display panel in accordance with some embodiments. It will be described with reference to the above figures. However, any suitable circuit, logic, unit, module, or sub-module may be employed. The method can be performed by any suitable circuit, logic, unit, module, or sub-module that can comprise hardware (e.g., circuitry, dedicated logic, programmable logic, microcode, etc.), software (e.g., instructions executing on a processing device), firmware, or a combination thereof. In some embodiments, operations 702-714 of method 700 may be performed in various orders. In an example, operations 702-714 may be performed sequentially, as shown in FIG. 7A. In another example, operations 702, 706, and 710 may be performed at the same time, and operations 704, 708, 712, and 714 may be performed sequentially after operations 702, 706, and 710. The orders of the operations should not be limited to the embodiments of the present disclosure.

Starting at 702, a first target luminance value and a target color temperature of a pixel may be determined. In some embodiments, the first target luminance value is a maximum luminance value of the pixel and the pixel displays white light at the first target luminance value. This may be performed by processor 400 or control logic 104. At 704, a first gate voltage of each subpixel in the pixel may be determined when the pixel is displaying the first target luminance value. The color temperature of the pixel may be the target color temperature. This may be performed by control logic 104. At 706, a second target luminance value may be determined at the target color temperature. The second target luminance value may be different than the first target luminance value. This may be performed by processor 400 or control logic 104. At 708, a second gate voltage of each subpixel in the pixel may be determined when the pixel is displaying the second target luminance value. The color temperature of the pixel may be the target color temperature. This may be performed by control logic 104. At 710, a third target luminance value may be determined at the target color temperature. The third target luminance value may be different than the first and second target luminance values. This may be performed by processor 400 or control logic 104. At 712, a third gate voltage of each subpixel in the pixel may be determined when the pixel is displaying the third target luminance value. The color temperature of the pixel may be the target color temperature. This may be performed by control logic 104. At 714, a luminance-voltage correlation (e.g., a mapping correlation between luminance values and gate voltages of each subpixel of the pixel) may be determined using the first, second, and third gate voltages and the first, second, and third target luminance values. This may be performed by processor 400 or control logic 104.

Figure 7B:
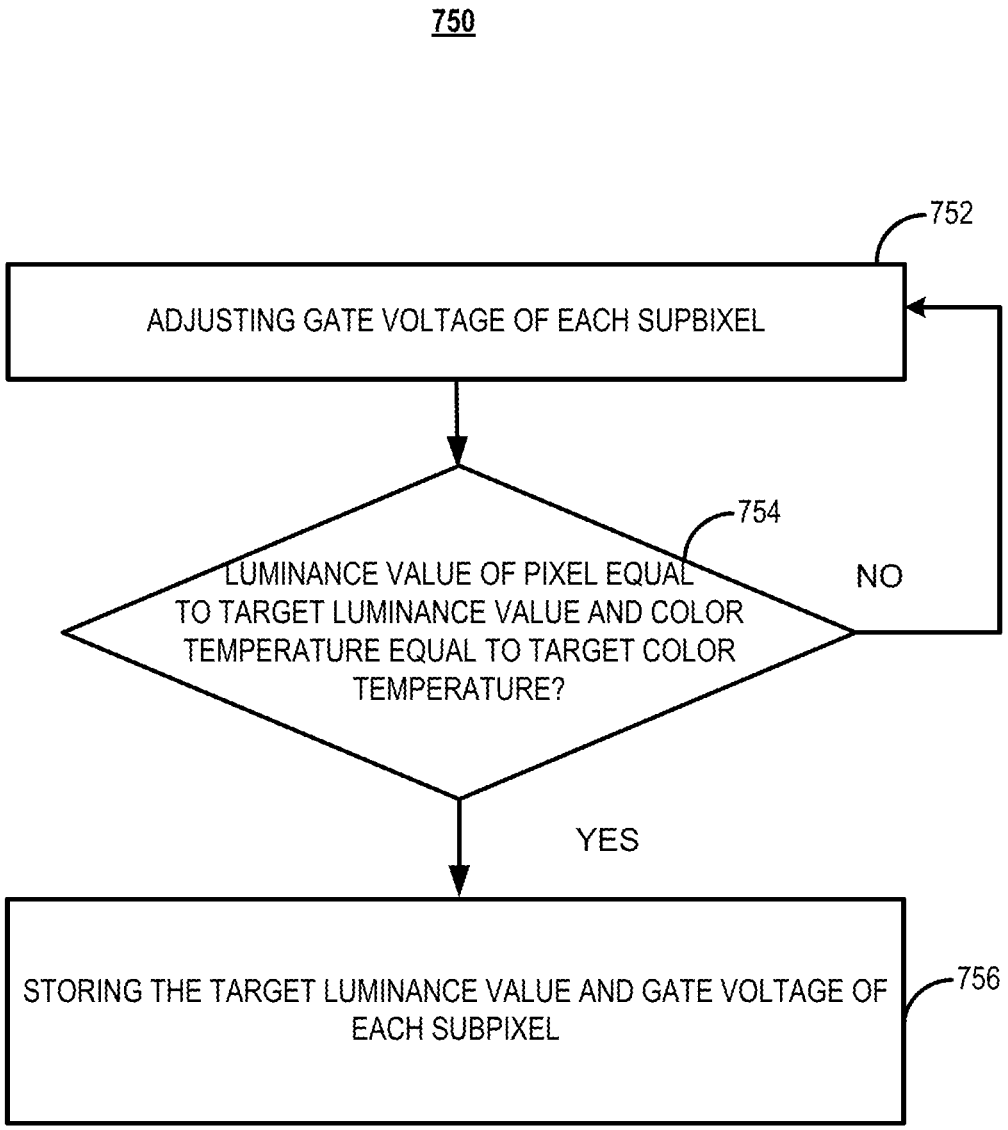
FIG. 7B illustrates an exemplary process flow to determine an actual gate voltage of a light-emitting element in the process flow shown in FIG. 7A, in accordance with some embodiments.

FIG. 7B is a flow chart of a method 750 for obtaining gate voltages of each subpixel in operations 704, 708, and 712 of method 700, in accordance with some embodiments. It will be described with reference to the above figures. However, any suitable circuit, logic, unit, module, or sub-module may be employed. The method can be performed by any suitable circuit, logic, unit, module, or sub-module that can comprise hardware (e.g., circuitry, dedicated logic, programmable logic, microcode, etc.), software (e.g., instructions executing on a processing device), firmware, or a combination thereof.

Starting at 752, the gate voltage of each subpixel of a pixel may be adjusted. The adjustment of the gate voltage may cause an adjustment of current flowing through the subpixel/OLED, so the luminance value of the subpixel can be adjusted/changed accordingly. This may be performed by gate scanning driver 304. At 754, it may be determined whether the luminance value of the respective pixel is equal to the target luminance value and the color temperature of the pixel is equal to the target color temperature. If yes, the process may proceed to 756; otherwise, the process may proceed to 752. In some embodiments, the gate voltages applied on all subpixel of the respective pixel may be adjusted to the total luminance value of the pixel may be adjusted. The target luminance value may respectively be the first target luminance value, the second target luminance value, and the third target luminance value. This may be performed by gate scanning driver 304. At 756, the target luminance value and the gate voltage of each subpixel at the target luminance value may be obtained and stored. This may be performed by gate scanning driver 304, control logic 104, and/or processor 400. In some embodiments, operations 752 and 754 may form a loop process. The gate voltage of a subpixel may continue to be adjusted until the respective pixel displays the target luminance value at the target color temperature.

Figure 8:
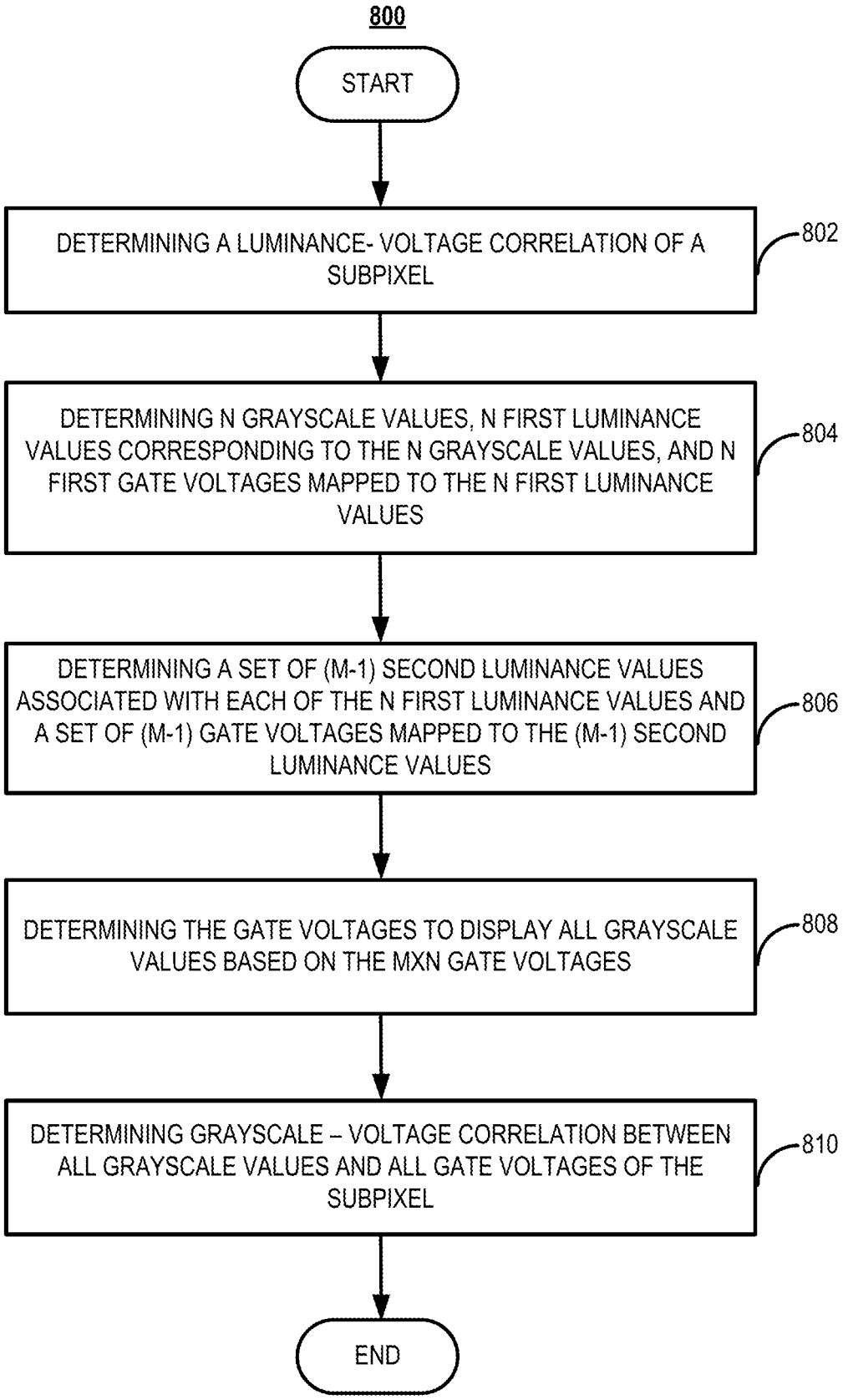
FIG. 8 illustrates an exemplary process flow to determine a grayscale-voltage correlation in accordance with some embodiments.

FIG. 8 is a flow chart of a method 800 for determining a grayscale-voltage correlation using the luminance-voltage correlation determined in FIG. 7A, in accordance with some embodiments. It will be described with reference to the above figures. However, any suitable circuit, logic, unit, module, or sub-module may be employed. The method can be performed by any suitable circuit, logic, unit, module, or sub-module that can comprise hardware (e.g., circuitry, dedicated logic, programmable logic, microcode, etc.), software (e.g., instructions executing on a processing device), firmware, or a combination thereof.

Starting at 802, the luminance-voltage correlation of a subpixel may be determined. This may be performed by processor 400 or control logic 104. At 804, N grayscale values of a respective pixel, N first luminance values corresponding to the N grayscale values, and N first gate voltages mapped to the N first luminance values may be determined. This may be performed by processor 400 or control logic 104. At 806, a set of (M−1) second luminance values associated with each one of the N first luminance values, and a set of (M−1) gate voltages mapped to the (M−1) second luminance values may be determined based on the luminance-voltage correlation. In some embodiments, the (M−1) second luminance values may each be a different dimmed luminance value of the respective first luminance value. This may be performed by processor 400 or control logic 104. At 808, the gate voltage applied on the subpixel to enable respective pixel to display all grayscale values may be determined based on the M×N gate voltages. This may be performed by processor 400 or control logic 104. At 810, the grayscale-voltage correlation may be determined. The grayscale-voltage correlation may be a mapping correlation between all the gate voltages applied on a subpixel to enable the respective pixel to display all grayscale values and the grayscale values. This may be performed by processor 400 or control logic 104.

Another aspect of the disclosure is directed to a non-transitory computer-readable medium storing instructions which, when executed, cause one or more processors to perform the methods, as discussed above. The computer-readable medium may include volatile or non-volatile, magnetic, semiconductor, tape, optical, removable, non-removable, or other types of computer-readable medium or computer-readable storage devices. For example, the computer-readable medium may be the storage device or the memory module having the computer instructions stored thereon, as disclosed. In some embodiments, the computer-readable medium may be a disc or a flash drive having the computer instructions stored thereon.

The above detailed description of the disclosure and the examples described therein have been presented for the purposes of illustration and description only and not by limitation. It is therefore contemplated that the present disclosure covers any and all modifications, variations or equivalents that fall within the spirit and scope of the basic underlying principles disclosed above and claimed herein.

What is claimed is:

1. A method for calibrating a plurality of voltages of a light-emitting element and a plurality of grayscale values of a respective pixel of the light-emitting element on a display panel, the pixel comprising the light-emitting element, comprising:

determining a mapping correlation between the plurality of voltages of the light-emitting element and a plurality of luminance values of the light-emitting element;

determining N grayscale values of the pixel, N being a positive integer and less than a number of the plurality of grayscale values;

determining N first luminance values each corresponding to the respective one of the N grayscale values;

determining N first voltages mapped to the N first luminance values using the mapping correlation;

determining, of each one of the N first luminance values, (M−1) second luminance values, each one of the (M−1) second luminance values corresponding to a different dimmed luminance value of the respective first luminance value, M being a positive integer;

determining, of each one of the N first luminance values, (M−1) second voltages mapped to the respective (M−1) second luminance values;

determining the plurality of voltages of the light-emitting element based on the N first voltages and (M−1)×N second voltages;

determining the plurality of grayscale values of the pixel based on the N grayscale values and (M−1)×N second luminance values; and determining a correlation of the light-emitting element between the plurality of voltages and the plurality of grayscale values by mapping the plurality of voltages to the plurality of grayscale values.

2. The method of claim 1, wherein determining a mapping correlation between the plurality of voltages of the light-emitting element and a plurality of luminance values of the light-emitting element comprises:

determining a plurality of target luminance values of a respective pixel of the light-emitting element;

determining a plurality of actual voltages of the light-emitting element in response to the pixel displaying the plurality of target luminance values; and determining the mapping correlation based on the plurality of target luminance values and the plurality of actual voltages.

3. The method of claim 2, wherein determining the plurality of target luminance values comprises determining at least 3 target luminance values.

4. The method of claim 3, wherein determining the at least 3 target luminance values comprise determining a maximum luminance value of the pixel, and determining at least two different target luminance values less than the maximum luminance value.

5. The method of claim 4, further comprising:

determining another mapping correlation between a plurality of other voltages and a plurality of other luminance values of another light-emitting element of the pixel, the light-emitting element and the other light-emitting element each displaying a different primary color;

determining, of the other light-emitting element, N first other voltages mapped to the N first luminance values using the other mapping correlation;

determining, of each one of the N first luminance values, (M−1) second other luminance values, each one of the (M−1) second other luminance values corresponding to a different dimmed luminance value of the respective first luminance value;

determining, of the other light-emitting element, (M−1) second other voltages mapped to the respective (M−1) second other luminance values for each one of the N first luminance values;

determining the plurality of other voltages of the other light-emitting element based on the N first other voltages and (M−1)×N second other voltages;

determining a plurality of other grayscale values of the pixel based on the N grayscale values and (M−1)×N second luminance values; and determining a correlation between, of the other light-emitting element, the plurality of other voltages and the plurality of other grayscale values by mapping the plurality of other voltages to the plurality of other grayscale values.

6. The method of claim 2, further comprising maintaining a target color temperature of the pixel when the plurality of target luminance values are displayed by the pixel.

7. The method of claim 2, wherein determining the plurality of actual voltages of the light-emitting element in response to a pixel of the light-emitting element displaying the plurality of target luminance values comprises measuring and storing the plurality of actual voltages of the light-emitting element from a display panel.

8. The method of claim 2, wherein the mapping correlation comprises a polynomial with a degree of at least 2, each one of the plurality of luminance values varying as a function of a respective one of the plurality of voltages following the polynomial.

9. The method of claim 2, wherein determining the plurality of actual voltages of the light-emitting element in response to the pixel displaying the plurality of target luminance values comprises:

adjusting a current of the light-emitting element so the respective pixel of the light-emitting element displays the plurality of target luminance values; and measuring and storing values of the plurality of actual voltages corresponding to the current in response to the respective pixel displaying the plurality of target luminance values.

10. The method of claim 2, further comprising storing the correlation of the light-emitting element between the plurality of voltages and the plurality of grayscale values in a register and employing the correlation as a lookup table to calibrate the grayscale values in a Gamma correction process.

11. The method of claim 1, wherein determining the N first luminance values each corresponding to the respective one of the N grayscale values comprising performing a power-law operation on the N grayscale values to obtain the N first luminance values.

12. The method of claim 11, wherein determining the plurality of voltages of the light-emitting element based on the N first voltages and (M−1)×N second voltages and determining the plurality of grayscale values of the pixel based on the N grayscale values and (M−1)×N second luminance values comprises:

performing an interpolation operation on the N first voltages and the (M−1)×N second voltages to obtain the plurality of voltages;

performing an inverse operation of the power-law operation on the (M−1)×N second luminance values to obtain (M−1)×N second grayscale values; and performing another interpolation operation on the N grayscale values and the (M−1)×N second grayscale values to obtain the plurality of grayscale values.

13. A method for calibrating voltages of a light-emitting element and luminance values of a respective pixel on a display panel, comprising:

determining a plurality of target luminance values and a target color temperature of a respective pixel;

determining a plurality of actual voltages of the light-emitting element in response to the pixel displaying the plurality of target luminance values; and determining a mapping correlation between the voltages and luminance values of the light-emitting element based on the plurality of target luminance values and the plurality of actual voltages.

14. The method of claim 13, wherein determining the plurality of target luminance values comprises determining at least 3 target luminance values.

15. The method of claim 14, wherein determining the at least 3 target luminance values comprise determining a maximum luminance value of the pixel, and determining at least two different target luminance values less than the maximum luminance value.

16. The method of claim 13, further comprising maintaining the target color temperature of the pixel when the plurality of target luminance values are displayed by the pixel.

17. The method of claim 13, wherein determining the plurality of actual voltages of the light-emitting element in response to a pixel of the light-emitting element displaying the plurality of target luminance values comprises measuring and storing the plurality of actual voltages of the light-emitting element from a display panel the light-emitting element is located in.

18. The method of claim 13, wherein the mapping correlation comprises a polynomial with a degree of at least 2, each one of the plurality of target luminance values varying as a function of the plurality of actual voltages following the polynomial.

19. The method of claim 13, further comprising:

determining a plurality of other actual voltages of another light-emitting element in response to the pixel displaying the plurality of target luminance values; and determining another mapping correlation based on the plurality of target luminance values and the plurality of other actual voltages.

20. A system for calibrating a plurality of voltages of a light-emitting element and a plurality of grayscale values of a respective pixel on a display panel, the pixel comprising the light-emitting element, comprising:

a display having the pixel; and a processor, comprising:

a grayscale-luminance converting sub-module configured to determine N first luminance values each corresponding to the respective one of N grayscale values of the pixel;

a luminance-voltage correlation analyzing sub-module configured to determine a mapping correlation between a voltage of the light-emitting element and a luminance value of the light-emitting element;

a grayscale-voltage mapping sub-module configured to determine N first voltages mapped to the N first luminance values using the mapping correlation;

a luminance-voltage mapping sub-module configured to determining, for each one of the N first luminance values, (M−1) second luminance values and (M−1) second voltages mapped to the respective (M−1) second luminance values, each one of the (M−1) second luminance values corresponding to a different dimmed luminance value of the respective first luminance value, M being a positive integer, and an interpolating sub-module configured to:

determine the plurality of voltages of the light-emitting element based on the N first voltages and (M−1)×N second voltages;

determine the plurality of grayscale values of the pixel based on the N grayscale values and (M−1)×N second luminance values; and determine a correlation of the light-emitting element between the plurality of voltages and the plurality of grayscale values by mapping the plurality of voltages to the plurality of grayscale values.

21. The system of claim 20, wherein the luminance-voltage correlation analyzing module is configured to:

determine a plurality of target luminance values of a respective pixel of the light-emitting element;

determine a plurality of actual voltages of the light-emitting element in response to the pixel displaying the plurality of target luminance values; and determine the mapping correlation based on the plurality of target luminance values and the plurality of actual voltages.

22. The system of claim 21, wherein the plurality of target luminance values comprises at least 3 target luminance values.

23. The system of claim 22, wherein the at least 3 target luminance values comprise a maximum luminance value of the pixel and at least two different target luminance values less than the maximum luminance value.

24. The system of claim 21, wherein the luminance-voltage correlation analyzing module is further configured to maintain a target color temperature of the pixel when the plurality of target luminance values are displayed by the pixel.

25. The system of claim 24, wherein:

the mapping correlation comprises a polynomial with a degree of at least 2, each one of the plurality of target luminance values varying as a function of the plurality of actual voltages following the polynomial; and the N first luminance values are correlated to the respective N grayscale values by an inversion of a power-law operation.

* * * * *